US005282713A

United States Patent [19]

Lande

[11] Patent Number: 5,282,713

[45] Date of Patent: Feb. 1, 1994

[54] APPARATUS FOR REMOVING RECYCLABLE MATERIALS FROM BAGS

[76] Inventor: Lars Lande, 11615 N. Shore Rd., Whitmore Lake, Mich. 48189

[21] Appl. No.: 982,709

[22] Filed: Nov. 27, 1992

Related U.S. Application Data

[63] Continuation-in-part of Ser. No. 775,003, Oct. 11, 1991, Pat. No. 5,203,665.

[51] Int. Cl.[5] ..... B02C 23/02

[52] U.S. Cl. ..... 414/412; 241/200; 241/DIG. 38; 100/1; 414/528; 414/502; 414/404; 83/155; 83/409; 83/423; 83/946; 83/857; 209/644; 198/34

[58] Field of Search ..... 414/411, 412, 502, 527, 414/528, 403, 404; 209/44.2, 644; 241/DIG. 38, 200; 100/1; 83/155, 409, 423, 946, 835, 857; 198/311, 607

[56] References Cited

U.S. PATENT DOCUMENTS 2,772,009 11/1956 Plusquellic .
3,889,442 6/1975 Grahn et al. .
4,067,506 1/1978 Cerroni .
4,183,472 1/1980 Packard et al. .

FOREIGN PATENT DOCUMENTS 2359031 2/1978 France .
310046 9/1971 U.S.S.R. .
605753 5/1978 U.S.S.R. .
825379 4/1981 U.S.S.R. .
1194778 11/1985 U.S.S.R. .
2060545 5/1981 United Kingdom .
2189213 10/1987 United Kingdom .

*Primary Examiner*—Frank E. Werner
*Attorney, Agent, or Firm*—Harness, Dickey & Pierce

[57] ABSTRACT

An apparatus for removing recyclable materials from bags. The apparatus includes a conveyor having tines which engage and assist the conveyor in transporting the bags of materials to a discharge bin. A cutting element cooperates with the conveyor to open the bags allowing the materials to be emptied from the bags at one end of the conveyor into the bin where the materials are subsequently discharged onto compost piles. The bags are then removed from the tines and transferred into a mechanism where they are bundled for disposal or recycling.

20 Claims, 4 Drawing Sheets

APPARATUS FOR REMOVING RECYCLABLE MATERIALS FROM BAGS

CROSS REFERENCE TO RELATED APPLICATION

This is a continuation-in-part of U.S. patent application Ser. No. 07/775,003 filed Oct. 11, 1991, now U.S. Pat. No. 5,203,665.

BACKGROUND AND SUMMARY OF THE INVENTION

This invention generally relates to waste recycling. More particularly, the invention relates to an apparatus which opens plastic bags containing recyclable materials and which disperses the materials at a large scale recycling facility. While the present invention will have utility with a wide range of recyclable materials, it is believed that the invention will have particular utility with compostable materials such as yard and garden waste.

As people have become more involved with recycling, composting has increasingly become a viable alternative for the disposal of organic waste such as leaves, branches and twigs. While the compost pile has been popular with homeowners for some time, composting has only recently gained popularity with municipalities as an effective method for reducing the volume of waste being disposed in general landfills.

A large scale compost yard, as would be used by a municipality or other community, generally includes a large number of compost rows or piles. Depending on the size of the municipality and the amount of composting being done, these rows may vary widely in size. Typically, however, the compost rows are six to eight feet in height, with taller compost rows being possible.

In collecting compostable materials from households for composting at the community site, the compostable materials are received in bags which are tied or otherwise closed. At the compost yard, the bags containing the compostable materials, hereinafter referred to as bales, must be manually opened, the compostable materials manually separated from the bags and manually spread onto the compost piles. This process is both time consuming and labor intensive. Obviously, it is desirable to mechanize this process enabling it to be done faster and in a more cost efficient manner.

In view of the procedure outlined above, it is an object of the present invention to substantially automate the opening of the bales and spreading of the compostable materials. In achieving this, the present invention provides an apparatus which efficiently and effectively opens the bales in which compostable materials are received at the compost yard. After opening the bales, the apparatus of this invention separates the compostable materials from the bags and disperses the compostable materials onto the compost rows. As such, the apparatus enhances the dissemination of the compostable materials once they are received at the compost yard.

The present invention generally includes an inclined conveyor of the endless belt variety. The belt of the conveyor is provided with projecting tines which, as the bales are loaded onto the conveyor, pierce the bags of the bales and hold the bales in position. As the bales are carried by the conveyor, a cutting element engages the bales and cuts the bags lengthwise. Spreading elements also act upon the bales to laterally spread open the bags and fully expose the compostable materials.

Located at the upper end of the conveyor is a receiving bin. Once an opened bale reaches the upper end of the conveyor, the tines pull the bale over the end of the conveyor, effectively dumping and emptying the compostable materials into the receiving bin. A blower operates to forcibly disperse the compostable materials through a discharge chute formed in one end of the receiving bin. The floor of the receiving bin is defined by another conveyor which further assists in forcibly discharging the compostable materials.

After the compostable materials have been emptied from the bags, the bags remain engaged on the tines and are drawn along the return or lower side of the conveyor. When drawn along the return side of the conveyor, the bags are wiped to remove any remaining compostable materials and are then removed from the tines.

To remove the bags from the tines, openings are provided in the conveyor belt and another blower blows on the bags through the openings forcing the bags into engagement with a pair of stripper conveyors. The stripper conveyors are oriented to provide a "pinch point" which effectively grabs the bags and pulls them off of the tines. In addition to the second blower, one of the stripper conveyors has tabs formed thereon which operate during rotation of the conveyors to "catch" and "slap" the bags into the pinch point. The stripper conveyors feed the bags into a conventional baling or bundling machine which, upon receiving an appropriate number of bags, produces a bale of used bags which can also be recycled.

Additional benefits and advantages of the present invention will become apparent to those skilled in the art to which this invention relates from the subsequent description of the preferred embodiment and the appended claims taken in conjunction with the accompanying drawings.

DETAILED DESCRIPTION OF THE PREFERRED EMBODIMENT

Figure 1:
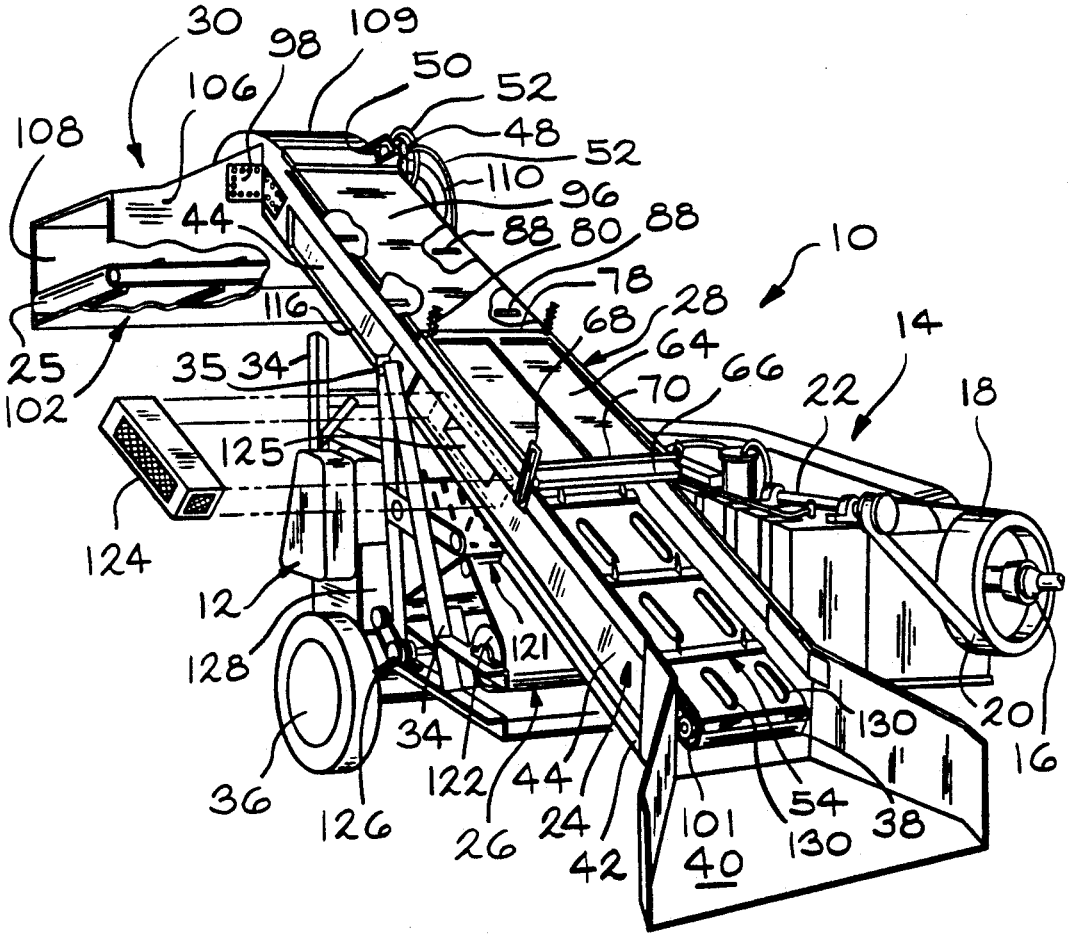
FIG. 1 is a perspective view of an apparatus embodying the principles of the present invention.

Now with reference to the drawing, an apparatus for opening and emptying bags containing compostable or recyclable materials, at a compost yard, including a mechanism for dispersing the materials, is shown in FIG. 1 and generally designated at 10. While the present invention is being described with particular reference to compostable materials, it should be understood that this particular description is one of illustration and is not intended to be read as limiting the scope of the invention. It is Applicant's belief that this invention will have utility with a wide range of recyclable materials, not just compostable materials.

The apparatus 10, hereinafter referred to as a composter 10, is provided for use in conjunction with a conventional bundling mechanism or baler 12 of the hay baling variety. Since the baler 12 is of a variety well known within the field of farm machinery, the baler 12 is only generally described herein.

The baler 12 includes a drive system 14 which serves to operate the actual baling functions of the bailer 12. The drive system 14 may be driven by a motor, self-contained within the baler 12 or preferably, as illustrated, by coupling the drive system 14 to the power take-off (PTO) 16 of a tractor (not shown). As illustrated in FIG. 1, the PTO 16 engages a fly wheel or pulley 18 which drives a belt 20 coupled to rotate a driveshaft 22 of the drive system 14. The driveshaft 22 may be coupled to a hydraulic pump (not shown) for operating hydraulic motors, as further described below. While hydraulic pumps and motors are preferred because of their reliability, other systems, such as pneumatic, mechanical and electrical systems, could alternatively be used to operate additional aspects of the invention.

In addition to the baler 12, the composter 10 includes four conveyors of the endless belt variety (hereinafter designated as primary conveyor 24, discharge conveyor 25, and a stripper conveyor 26), an opening station 28, a discharge station 30 and a bag removal station 32. The various stations are all provided so as to cooperate with the primary conveyor 24 during operation of the composter 10.

The primary conveyor 24 is mounted to the baler 12 by a frame 34 which allows the primary conveyor 24 to pivot about mounting 35. The pivotable mounting 35 permits the primary conveyor 24 to be moved between an inclined operable position and a substantially horizontal inoperable position (not shown). In its inoperable position, the composter 10 is capable of being moved around the compost yard or being trailered. To permit trailering over longer distances, the bailer 12 is provided with wheels 36, one of which can be seen in the Figures, and the primary conveyor 24 may be removed from the frame 34 at the pivot 35 or locked into its horizontal position.

In its operational position, shown in FIG. 1, the primary conveyor 24 is inclined and an endless belt 38 is rotated so that the bags containing the compostable materials (not shown), hereinafter referred to as bales, are transferred from a feed hopper 40, at the lower end 42 of the primary conveyor 24, to the discharge station 30 located at its upper end 98. The feed hopper 40 is mounted to a pair of opposing side walls 44 of the primary conveyor 24 and may be permanently welded or bolted to the side walls 44 enabling removal of the feed hopper 40 if desired. The feed hopper 40 has a flared or shovel configuration to assist in loading the bales onto the belt 38 of the primary conveyor 24 and may also include a protective hood (not shown).

The bales are placed onto the support surface defined by the belt 38 either manually or by an alternate mechanical method which will individually feed the bales. Rotated by a chain drive or other system 48, the belt 38 is driven by a hydraulic motor 50 which is coupled by lines 52 to the hydraulic pump mentioned above.

Figure 6:
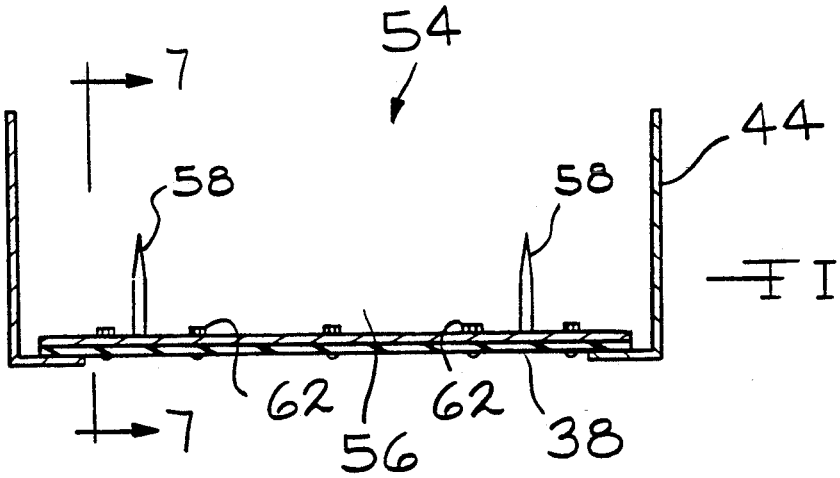
FIG. 6 is a cross sectional view illustrating the orientation of the tines utilized with the present invention.
Figure 7:
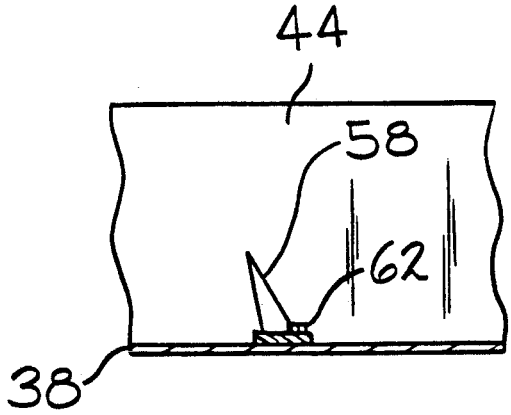
FIG. 7 is a cross sectional view substantially taken along line 7—7 in FIG. 6 further illustrating the orientation of the tines utilized with the present invention.

Bale holders 54 are provided at spaced apart intervals along the length of the belt 38 to securely hold the bales onto the belt 38. The bale holders 54 are best seen in FIGS. 6 and 7. The bale holders 54 extend across the width of the belt and include a mounting plate 56 to which are secured a pair of retaining tines 58. Bolts 62 or other suitable fasteners, are used to mount and secure the mounting plate 56 and the tines 58 to the belt 38.

The tines 58 extend generally upward from the belt 38 and plate 56 so that, as a bale is loaded onto the belt 38, the weight of the bale causes the bale to become impaled upon the tines 58. In this manner, the tines 58 assist in carrying the bales up the primary conveyor 24. If a bale fails to become engaged upon the tines 58, the upward extension of the next adjacent tines 58 will prevent the bale from sliding or rolling down the incline of the conveyor 24. The tines 58 also prevent the bags themselves from rolling about or around the compostable materials as the bags are opened during engagement with the opening station 28. While only one pair of tines 58 are illustrated for each bale holder 54, a greater or lesser number may also be used.

The tines 58 are also oriented so that they extend longitudinally forward relative to the belt, or in other words, in the direction in which the belt 38 is being rotated. Since the tines 58 are angled forward relative to the belt 38, the likelihood that a bale will accidentally pull off of the tines 58 is decreased.

Figure 2:
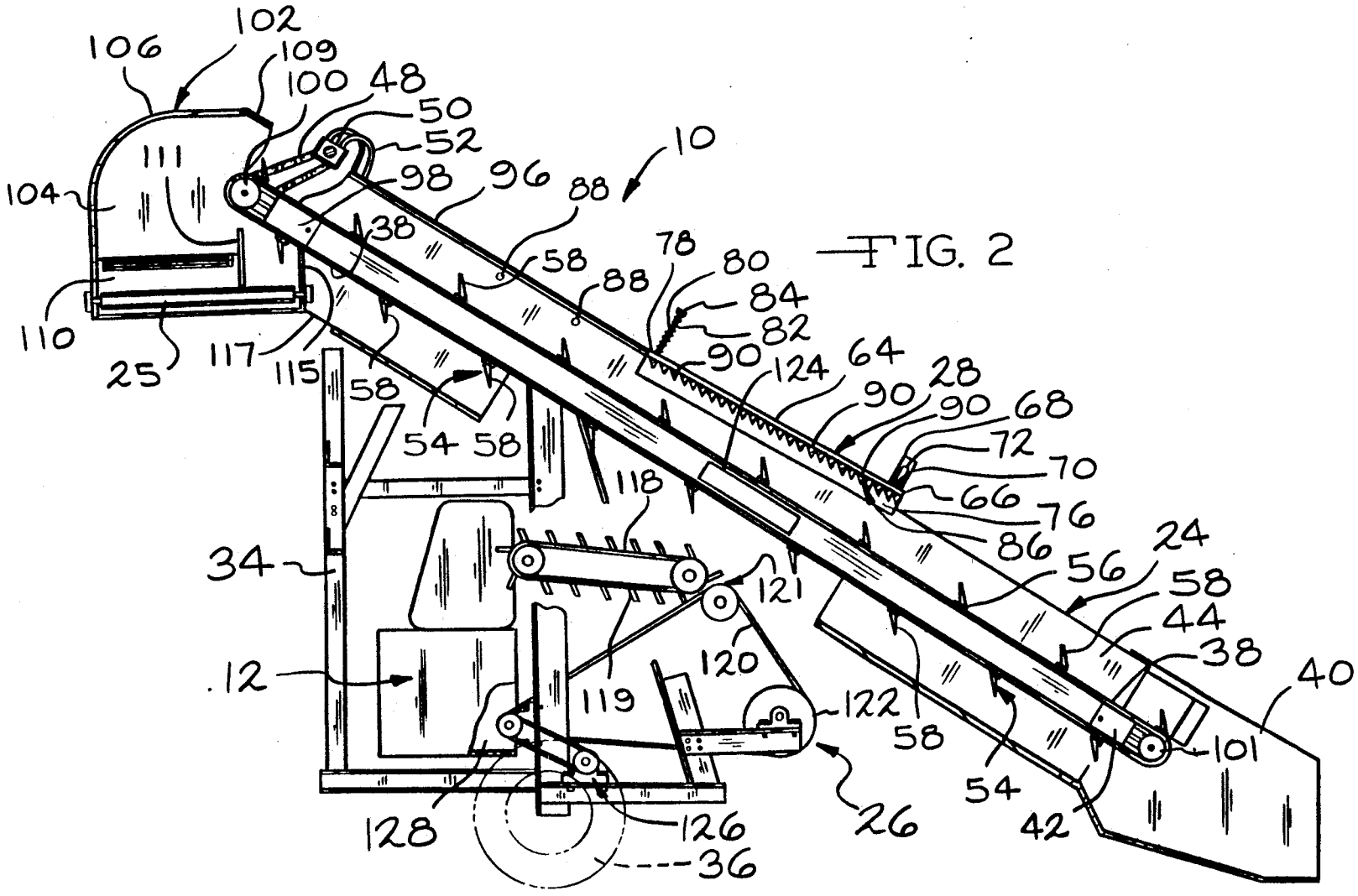
FIG. 2 is a side elevational view with portions broken away illustrating various components of the invention shown in FIG. 1.
Figure 3:
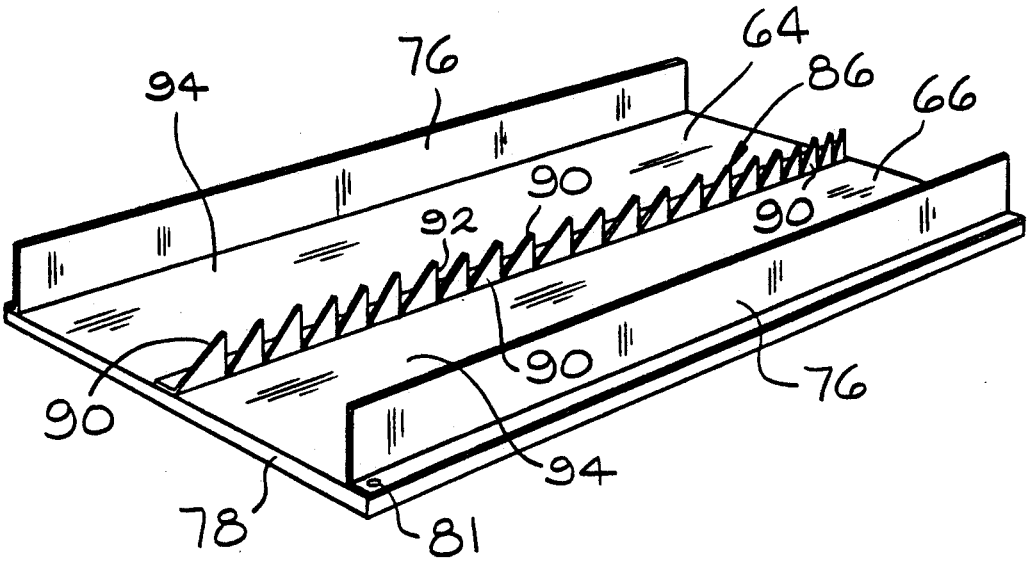
FIG. 3 is a perspective view of the underside of the cutting element utilized in conjunction with the present invention.
Figure 4:
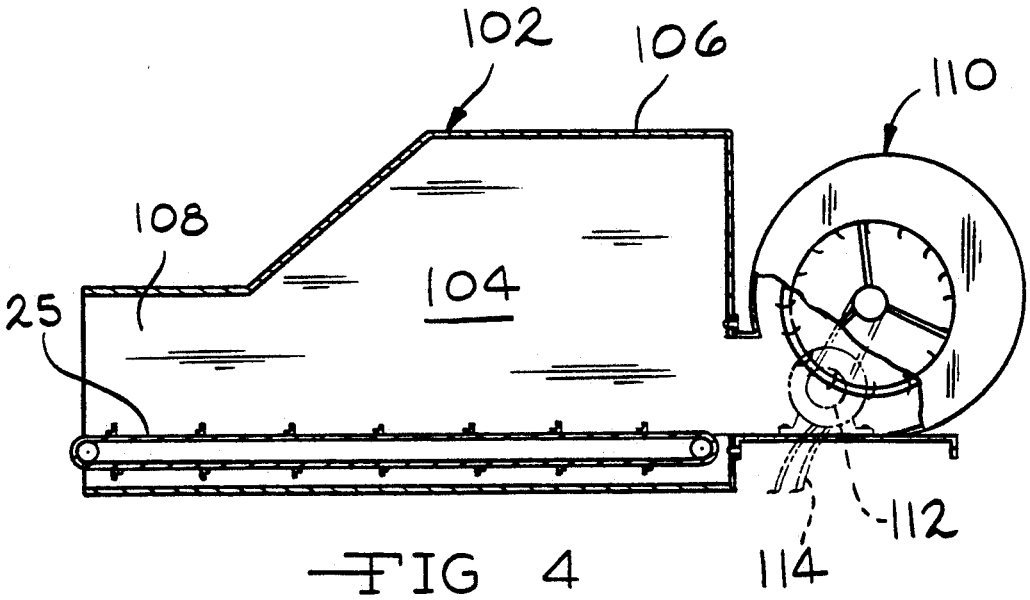
FIG. 4 is a cross sectional view of the blower and receiving bin utilized with the present invention.
Figure 5:
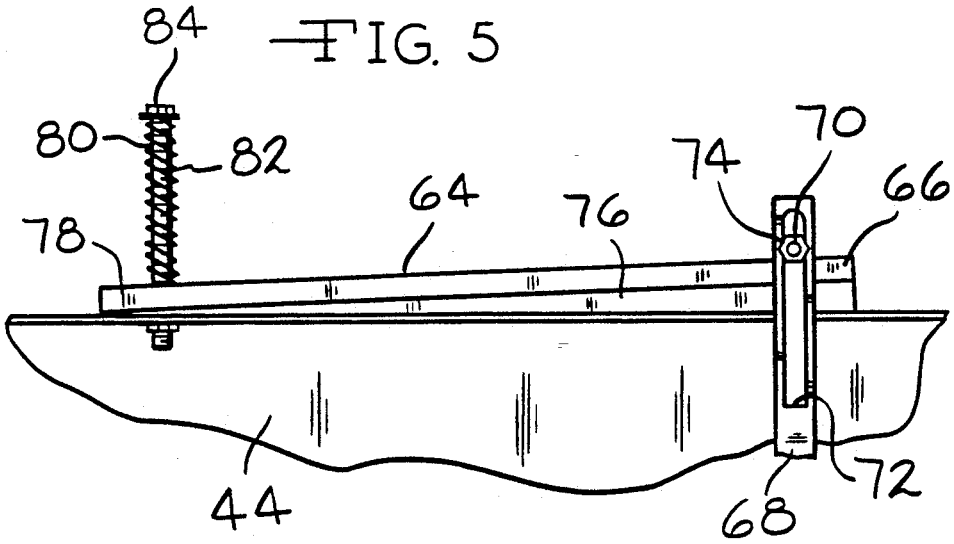
FIG. 5 illustrates the mounting mechanism for the cutting element shown in FIG. 3.

Now with reference to FIGS. 2, 3, and 5, positioned approximately midway up the incline of the primary conveyor 24 is the opening station 28. The opening station 28 includes a cutting element supported on a backing plate 64 which is mounted between the side walls 44 of the primary conveyor 24. To compensate for thickness variations in the bales encountered at the opening station 28, the leading end 66 of the backing plate 64 freely floats relative to the belt 38 while the trailing end 78 is biased in the direction of the belt 38.

Extending between the opposing side walls 44, the backing plate 64 is mounted at the leading end 66 to freely float, depending on the thickness of the bale, in a direction generally normal to the support surface of the belt 38. The leading end 66 of the backing plate 64 includes a rod 70, welded thereto, which transversely extends so that its ends are positioned within slots 72 of brackets 68 mounted to the side walls 44. The outboard ends of the rod 70 are threaded and engaged by nuts 74 which prevent the rod 70 from being pulled out of the slots 72.

When the leading end 66 of the opening station 28 encounters a bale having an increased thickness, the bale will be pulled into the opening station 28 by the tines 58 and the bag of the bale may experience a small amount of roll. The thickness of the bale, causes the rod 70 to move upwardly within the slots 72, accordingly varying the height of the leading end 66 above the belt 38 and permitting the remainder of the bale to enter into opening station 28.

The trailing end 78 of the backing plate 64 is mounted to the primary conveyor 24 at a distance which is closer to the surface of the belt 38 than the leading end 66. The trailing end 78 is mounted to posts 80 which extend upwardly from the side walls 44 through openings 81 in the backing plate 64. A biasing member or spring 82 is positioned above the backing plate 64 over the post 80 and retained thereon by a nut or cap 84. The spring 82 biases the trailing end 78 of the backing plate 64 toward the belt 38 until a bale of significant thickness is encountered, at which point the trailing end 78 will be caused to move away from the surface of the belt 38 against the influence of the spring 82. As will become more apparent from the discussion which follows, the biased mounting of the trailing end 78 encourages engagement between the bales and the cutting elements of the opening station 28 thereby ensuring that the bags are opened.

Mounted to the backing plate 64 and extending toward the belt 38 is a cutting member or knife 86. The knife 86 extends longitudinally along the backing plate 64 and is generally centered with respect to the width of the belt 38. As illustrated the knife 86 includes serrations or teeth 90. However, the knife 86 could utilize a single cutting edge.

During operation of the composter 10, a bale is carried by the bale holders 54 from the feed hopper 40 to a point where the knife 86 of the opening station 28 begins to engage with the bag of the bale. As the bale continues to travel up the primary conveyor 24, the knife 86 will engage the bag and longitudinally cut the bag open. Typically the bag will be made of a plastic material, however, paper bags are increasingly being used in the collection of compostable materials.

The backing plate 64 is also provided with downward side extensions 76 that are interiorly adjacent to the side walls 44. The side extensions 76 prevent compost material from being inadvertently blowing out of the primary conveyor 24 after the bale has been opened at the cutting station 28.

If desired, more than one cutting station 28 may be successively provided on the composter 10 thereby further ensuring that the bags are longitudinally opened.

As the opened bales leave the cutting station 28, a cover plate 96, extending between the opposing side walls 44 of the primary conveyor 24, additionally prevents the inadvertent blowing of the exposed compostable materials from the primary conveyor 24. The cover plate 96 may be secured to the side walls 44 in any convenient manner. However, it is preferred that the cover plate 96 is removably secured to readily permit servicing of the composter 10 if needed.

After the bags have been longitudinally cut open at the cutting station 28, the bags encounter spreader pin 88 which operates to pull on flaps of the open bags and laterally open the bags. The spreader pins 88 are mounted so as to extend laterally inward from the side walls 44 of the primary conveyor 24 at a height generally corresponding to the height of the tines 58. During operation, the pins 88 "catch" or "snag" on the flaps of the open bag and pull the flaps laterally outward as the bag travels past on the belt 38.

At its upper end 98, the belt 38 is reversed in direction over a roller 100 and returns to the lower end 43. A similarly roller 101 is located at the lower end 42 of the primary conveyor 24 to reverse the direction of the belt 38 for advancement to the discharge or upper end 98.

As the opened bales are carried over the roller 100, the compostable materials are emptied from the plastic bag into a receiving bin 102 mounted at the upper end 98 of the primary conveyor 24. The receiving bin 102 includes a housing 106 which defines a central receiving chamber 104 and a discharge chute 108. The floor of the receiving bin 102 is formed by the discharge conveyor 25 mentioned earlier which is driven by a hydraulic or other type of motor 112.

Attached to the central receiving chamber 104, opposite of the discharge chute 108, is a drum type blower 110. The blower 110 is preferably also driven by the hydraulic motor 112 which is connected by lines 114 to the hydraulic pump previously mentioned. If desired, alternative drive systems may be employed to drive the blower 110.

During operation of the composter 10, the compost materials received in the central receiving chamber 104 will be emptied onto the discharge conveyor 25. The combination of the rotation of the discharge conveyor 25 and the blowing force of the blower 110 cooperate to disperse the materials out of the chamber 104 through the discharge chute 108. The discharge chute 108 is smaller in size than the central receiving chamber 104 and serves to specifically direct the compostable materials onto the compost rows of the compost yard. By using the combination of the blower 110 and the discharge conveyor 25, lower operational speeds of the conveyor 25 and blower 110 can be realized while overall operation speed of the composter 10 is increased. If desired, the blower 110 and the discharge conveyor 25 could also be used independent of each other.

To prevent compostable materials from being inadvertently blown from the composter 10 as they are being emptied into the receiving bin 102, a hood 109 extends from the cover plate 96 to the housing 106 of the receiving bin 102. A baffle plate 111 is also located within the receiving bin 102 at a position generally beneath the upper end 98 of the primary conveyor 24. The baffle plate 111 is oriented to extend transversely of the primary conveyor 24 and axially with the discharge conveyor 25.

By locating and positioning the baffle plate 111 as described above, several benefits are achieved. First, as the opened bales are carried over the upper end 98 of the primary conveyor 24, the bags will be "slapped" against the baffle plate 111 causing any materials clinging to the bag to be dislodged. The baffle plate 111 also prevents the compostable materials from being blown down along the return path of the conveyor 24. The blowing force of the blower 110 is also directed by the baffle plate 111 toward the discharge chute 108.

After emptying the compostable materials, the bags are pulled by the tines 58 by the belt 38 along the return path of the primary conveyor 24. The bags remain engaged on the tines 58 and are pulled through a lower cover 116. The lower cover 116 defines a narrow return path for the conveyor 24, approximately equal to the distance between the tines 58. The narrow width of the return path keeps the bags properly oriented for removal from the belt 38 and tines 58.

Residual compostable material remaining in the bag as it travels along the return path will be removed from the bag by a wiper 115. The wiper 115 is a flexible member, constructed from belt material, which extends upward from the lower cover 116 and which passes between the pairs of tines 58 to scrape or wipe the residual material out of the bags. The material removed from the bags by the wiper 115 falls onto the discharge conveyor 25 and is discharged as described above.

In the event that material remains attached to the bag after it passes the wiper 115, an opening 117 is provided in the lower cover 116 through which they may fall under the influence of gravity.

As the empty bags pass out of an end opening in the lower cover 116, the bags reach the stripper conveyor generally designated at 26. The stripper conveyor 26 is actually two conveyors, referred to as upper and lower conveyors 118 and 120. The upper and lower conveyors 118 and 120 cooperate to strip or remove the bags from the tines 58 of the primary conveyor 24. Like the primary conveyor 24, both the upper and lower stripper conveyors 118 and 120 are hydraulically coupled to the drive shaft 22 or an independent motor 126 for rotation.

The upper and lower conveyors 118 and 120 are rotated in opposite senses or directions and are positioned so that an end of the upper conveyor 118 is adjacent to an end of the lower conveyor 120. These adjacent ends define what is herein referred to a pinch point 121.

The pinch point 121 is positioned near the primary conveyor 24 and operates to catch or grab the bags, hanging from tines 58, and strip them from the primary conveyor 24. At the pinch point 121, the upper and lower conveyors 118 and 120 may actually contact one another or they may exhibit a small space therebetween.

To assist the stripper conveyors 26 in removing the bags from the primary conveyor 24, tabs 119 are provided on the upper conveyor 118. The tabs 119 are strips of resilient material, approximately four (4) to five (5) inches long, which extend generally outward from the belt of the upper conveyor 118. During rotation of the stripper conveyors 26, the tabs 119 tend to grab or slap the bags down into the pinch point 121 which then pulls the bags off of the tines 58.

As seen in FIG. 2, one end of the lower conveyor 120 is positioned to transfer the emptied bags into a mouth 128 of the baler 12. After a sufficient number of bags have been deposited into the mouth 128 of the baler 12, the baler 12 is operated to produce a bundle of the bags which can then be recycled or otherwise properly disposed.

To further assist the stripper conveyor 26 in removing the empty bags from the primary conveyor 24 and to allow the composter 10 to run at higher operational speeds, another rotating drum blower, referred to as stripper blower 124, is positioned so that the direction of its blowing force corresponds with and is directed at the pinch point 121. The stripper blower 124 is located to one side of the primary conveyor 24 and includes a duct 125 which extends between the advancing and returning paths of belt 38. The duct 125 includes a bend which directs blowing force of the stripper blower 124 toward the pinch point 121. Alternatively, the stripper blower 124 could be a different type of blower, including a supply of compressed air, similarly having its blowing force directed toward the pinch point 121. As such, the bags would be removed as discussed above and the tabs 119 omitted from the upper conveyor 118 if the blowing force of the compressed air supply proved to be sufficient.

To enable the blowing force to "blow" the bags into engagement with the pinch point 121 and the stripper conveyor 26, paired openings 130 are defined in the belt 38 between each successive set of retaining tines 58. The blowing force therefore travels through these openings and pushes the free end of the bags generally downward toward the pinch point 121. While the openings 130 are shown as being located immediately behind and corresponding with the pairs of tines 58, other positions for the openings 130, and other numbers of openings could be used.

While the above description constitutes the preferred embodiment of the present invention, it will be appreciated that the invention is susceptible to modification, variation and change without departing from the proper scope and fair meaning of the accompanying claims.

What is claimed is:

1. An apparatus for removing recyclable materials from bags comprising:

a primary conveyor including a frame, said primary conveyor having first and second ends and including a primary belt being operable for rotation in a direction about said first and second ends, said primary belt including a plurality of retaining tines extending therefrom and being positioned at spaced apart intervals thereon, said retaining tines receiving said bags thereon and carrying said bags along said primary conveyor as said primary belt rotates;

means for rotating said primary belt about said first and second ends;

a cutting element mounted to said frame and being positioned relative to said primary belt so as to cuttingly engage said bags during rotation of said primary belt thereby longitudinally opening said bags; and a receiving bin positioned adjacent to said second end, said receiving bin receiving said materials being emptied from said bags as said bags are carried about said second end, said receiving bin including a discharge opening and means for forcibly discharging said materials from said receiving bin through said discharge opening, said discharge means including a discharge conveyor having a discharge belt, said discharge belt forming a movable floor in said receiving bin and being positioned within said receiving bin at a location to receive said materials from said primary conveyor, said discharge belt being rotatable about first and second ends in a direction causing said materials to be forcibly discharged through said discharge opening.

2. An apparatus as set forth in claim 1 wherein said retaining tines are generally angularly oriented in the direction of rotation of said belt.

3. An apparatus as set forth in claim 1 wherein said cutting element includes a knife.

4. An apparatus as set forth in claim 1 wherein said discharge means also includes a blower attached to said receiving bin, said blower providing a blowing force in the direction of rotation of said discharge belt for blowing said materials out of said discharge bin through said discharge opening.

5. An apparatus as set forth in claim 4 wherein said discharge bin also includes a baffle plate positioned therein at a location substantially beneath said primary conveyor, said baffle plate directing said blowing force of said blower toward said discharge opening.

6. An apparatus as set forth in claim 1 further comprising means for removing said bags from said retaining tines after the emptying of said materials.

7. An apparatus as set forth in claim 1 further comprising wiping means for removing portions of said materials remaining in said bag after said materials have been emptied into said receiving bin, said wiping means including a resilient member mounted to said apparatus, said member extending between said retaining tines as said belt is rotated after said materials have been emptied from said bags.

8. An apparatus for removing recyclable materials from bags comprising:

a primary conveyor including a frame, said primary conveyor having first and second ends and including a primary belt having a support surface for supporting said bags, said primary belt being operable for rotation in a direction about said first and second ends, a plurality of retaining tines extending from said support surface of said primary belt and being positioned at spaced apart intervals thereon to receive said bags thereon and carry said bags along said conveyor as said primary belt is rotated;

a cutting member mounted to said frame and being positioned relative to said primary belt so as to cuttingly engage said bags being carried on said support surface during rotation of said primary belt thereby longitudinally opening said bags;

a receiving bin positioned adjacent to said second end of said primary conveyor, said receiving bin receiving said materials being emptied from said bags as said bags are carried about said second end, said receiving bin including a discharge opening and means for forcibly discharging said materials from said receiving bin through said discharge opening; and means for removing said bags from said retaining tines after said materials have been emptied therefrom, said removing means including a blower mounted to said apparatus and positioned to provide a blowing force onto said bags after said materials have been emptied therefrom, said blowing force at least partially assisting in removing said bags from said retaining tines.

9. An apparatus as set forth in claim 8 wherein said belt includes portions defining apertures therethrough.

10. An apparatus as set forth in claim 9 wherein said blowing force of said blower is directed through said apertures.

11. An apparatus as set forth in claim 10 wherein said blowing force of said blower is directed through said apertures from a side of said primary belt opposite said support surface.

12. An apparatus as set forth in claim 8 wherein said removing means further includes a second conveyor positioned to cooperate with said blower in removing said bags.

13. An apparatus as set forth in claim 12 wherein said blowing force is directed toward said second conveyor.

14. An apparatus as set forth in claim 13 wherein said second conveyor includes means for exerting a pulling force on said bags to remove said bags.

15. Apparatus for opening plastic bags containing compostable materials and for removing said materials therefrom, said apparatus comprising:

a first conveyor including a first belt being rotatable about first and second ends, said belt generally defining a support surface for carrying said bags from said first end to said second end;

a plurality of retaining tines extending from said support surface of said belt to retainingly receive said bags thereon, said retaining tines being positioned at spaced apart intervals along a length of said belt and rotating therewith;

a cutting element being adjustably positioned with respect to said belt to cuttingly engage said bags as said belt is rotated and thereby open said bags, said cutting element substantially longitudinally opening said bags;

lateral opening means mounted to said first conveyor for substantially laterally opening said bags after said bags have been longitudinally opened;

a housing defining a receiving chamber adjacent said second end of said conveyor, said receiving chamber receiving materials being emptied from said bags as said bags are rotated about said second end with said belt, said housing having a portion defining a discharge opening and including means for forcibly discharging said materials through said discharge opening; and means for removing said bags from said retaining tines, said removing means including a secondary conveyor having a pair of rotatable second belts, said second belts rotating in opposite directions of one another and each having an end cooperating with an end of the other belt to define a pinch point, the rotational directions of said second belts and said pinch point cooperating to engage and exert a pulling force on said bags thereby causing said bags to be removed from said retaining tines.

16. An apparatus as set forth in claim 15 wherein said removing means also includes a blower located to provide a blowing force onto said bags causing a free portion of said bags to be engaged by said secondary conveyor at said pinch point and removed from said retaining tines.

17. An apparatus as set forth in claim 16 wherein said removing means also includes portions defining apertures in said first belt.

18. An apparatus as set forth in claim 17 wherein said blowing force of said blower is directed through said apertures.

19. An apparatus as set forth in claim 18 wherein said blowing force of said blower is directed through said apertures from a side of said first belt opposite said support surface.

20. An apparatus as set forth in claim 15 wherein one of said second belts includes a plurality of resilient tabs extending generally outward therefrom, said tabs cooperating to engage said bags and assist in their removal.

* * * * *